United States Patent [19]

Coldren et al.

[11] 4,436,358

[45] Mar. 13, 1984

[54] TERMINAL TAB INTENDED FOR MOUNTING ON A CIRCUIT BOARD

[75] Inventors: Daniel R. Coldren, Enola; Dennis P. Schwenk, Hummelstown, both of Pa.

[73] Assignee: AMP Incorporated, Harrisburg, Pa.

[21] Appl. No.: 364,151

[22] Filed: Mar. 31, 1982

[51] Int. Cl.[3] ..... H01R 9/09

[52] U.S. Cl. ..... 339/17 C; 339/220 R

[58] Field of Search ..... 339/17 C, 220 R, 220 A, 339/220 C, 220 L, 220 T

[56] References Cited

U.S. PATENT DOCUMENTS

| | | | |
|---|---|---|---|
| 2,768,429 | 10/1956 | Willis | 339/220 R |
| 2,898,518 | 8/1959 | Lynn | 339/17 C |
| 2,914,745 | 11/1959 | Krol et al. | 339/220 R |
| 3,989,345 | 11/1976 | De Vito | 339/220 R |
| 4,158,745 | 6/1979 | Keller | 339/276 SF |
| 4,199,654 | 4/1980 | De Ross | 339/220 R |

FOREIGN PATENT DOCUMENTS

| | | | |
|---|---|---|---|
| 140611 | 3/1980 | German Democratic Rep. | 339/17 C |
| 589765 | 6/1947 | United Kingdom | 339/220 R |

OTHER PUBLICATIONS

AMP Engineering & Purchasing Guide, Edition 4 (1979), pp. 1-234 and 1-228.

*Primary Examiner*—John McQuade
*Assistant Examiner*—Gary F. Paumen
*Attorney, Agent, or Firm*—F. W. Raring

[57] ABSTRACT

Tab-type terminal intended for circuit board mounting comprises a tab having a base portion which extends laterally beyond the side edges of the tab. A mounting leg extends from the base portion and has convergent side edges. A slot is provided in the leg extending toward the base portion and divides the mounting leg into two sections. A pair of stabilizing arms extended in opposite directions from the base portion normally of the planes of the major surfaces of the tab.

7 Claims, 5 Drawing Figures

TERMINAL TAB INTENDED FOR MOUNTING ON A CIRCUIT BOARD

FIELD OF THE INVENTION

This invention relates to tab-type terminals and particularly to tab terminals which are intended for mounting on a circuit board.

BACKGROUND OF THE INVENTION

It is common practice to provide disengageable connections by means of a terminal tab on the one of the conductors and a terminal receptacle on the other conductor. Terminal tabs used in this type of disengageable connections are relatively simple flat stamped rectangular members of relatively thick stock metal, in the range of about 0.51 mm to about 0.81 mm. The receptacles used with tabs of this type are stamped and formed sheet metal members having a web and curled sidewalls, the edges of which are opposed to the web. Upon coupling the terminals the tab is received between the edges of the sidewalls and the surface of the web. Electrical connections of this type are of high quality and, depending upon the dimensions of the terminals, are capable of carrying a relatively high amperage. The force required to couple the receptacle to the tab is relatively high and this fact contributes to the high quality of the electrical connection.

Terminal tabs and receptacles of the type described above are used usually when it is desired to connect two wires to each other or to connect a wire to an electrical device such as an electrical timer. In the latter case, the tab is mounted on the electrical device and the mounting of the tab must be capable of withstanding the relatively high forces imposed when a receptacle is coupled to the tab.

Tab-type terminals are used to a limited extent on circuit boards and there are known types of terminal tabs which can be mounted on the circuit board and soldered to conductors on the board. The available tabs intended for circuit board mounting occupy an unduly large area on the circuit board and they do not secure the terminal to the circuit board with sufficient firmness. One type of terminal tab intended for circuit board mounting has a rolled cylindrical mounting portion which is inserted into a circuit board hole and another type has spaced apart mounting legs which extend from an enlarged base that rests upon the surface of the circuit board. The latter type, having the flat base, is objectionable under some circumstances because of the fact that it occupies a relatively large area on the surface of the circuit board, a condition which is intolerable if the circuit board is crowded with components.

The present invention is directed to the achievement of an improved terminal tab intended for circuit board mounting which can be manufactured by simple stamping methods, which occupies a minimum amount of surface area on the circuit board, and which can be clinched or staked to the circuit board in a manner such that it is rigidly and securely held thereon so that it is capable of withstanding stresses imposed when a receptacle is coupled thereto.

A tab-type terminal in accordance with the invention is of the general type comprising a flat rectangular tab having a free end and a mounting end, the mounting end having means for mounting the terminal on a circuit board. The tab has oppositely facing parallel major surfaces and oppositely facing parallel edge surfaces extending from the free end to the mounting end. A terminal in accordance with the invention is particularly characterized in that the mounting end comprises a base portion having oppositely facing major surfaces which are co-planar with the major surfaces of the tab. The base portion extends laterally beyond the edge surfaces of the tab whereby stop shoulders are provided which are directed towards the free end of the tab, these stop shoulders serving to limit the movement of a receptacle when it is coupled to the tab. A mounting leg extends from the base portion and is located between the side edges of the base portion. The mounting leg has convergent side edges and a slot therein between the side edges which extends towards the base portion and divides the mounting leg into two side-by-side co-planar sections. A pair of stabilizing arms extend in opposite directions from the base portion normally of the planes of the major surfaces of the base portion, the stabilizing arms having co-planar support surfaces for stabilizing the terminal on the surface of the circuit board.

In accordance with a further embodiment the mounting leg is integral with a carrier strip having a plurality of identical tab-type terminals extending therefrom at spaced intervals and the mounting leg is located centrally between the stabilizing arms.

THE DRAWING FIGURES

THE PREFERRED EMBODIMENT

Figure 1:
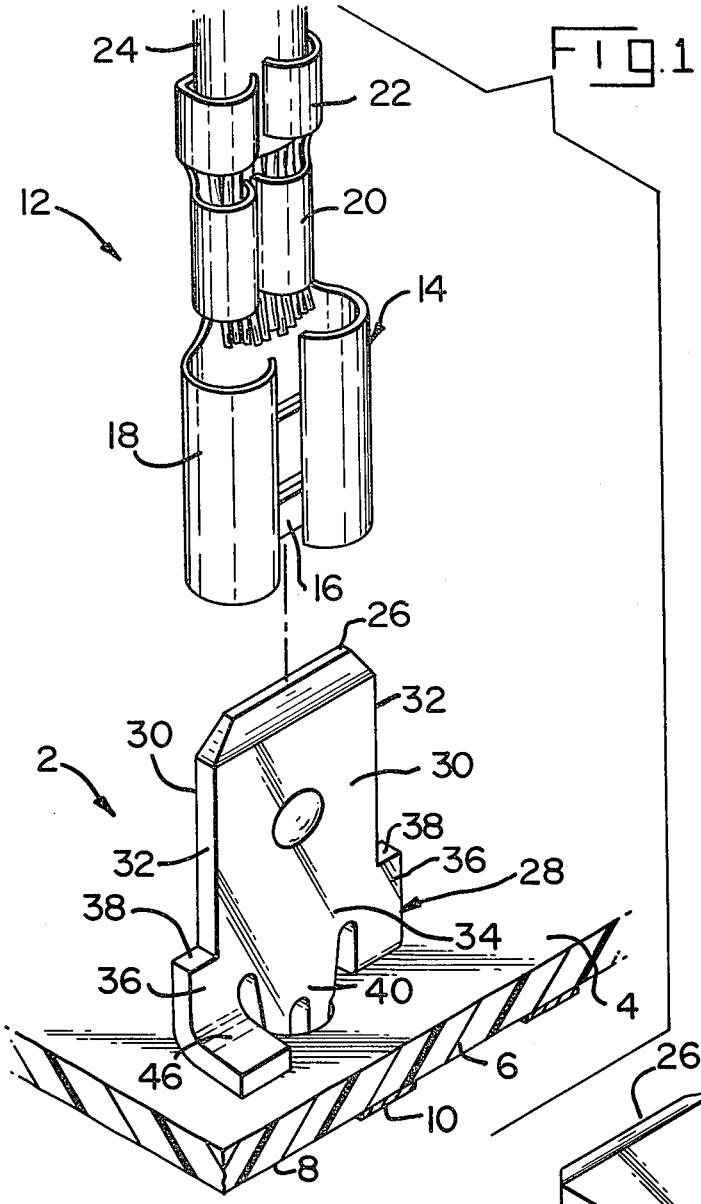
FIG. 1 is a perspective view showing a terminal tab in accordance with the invention mounted on a circuit board and showing a complimentary receptacle terminal in alignment with the tab.

As shown in FIG. 1, the tab-type terminal 2 in accordance with the invention is intended for mounting on the upper surface 4 of a circuit board 6 having a lower surface 8 on which there are conductors 10. The tab-type terminal is mateable with a commonly known type of disconnect terminal 12 having a receptacle portion 14 which can be coupled to the tab. The receptacle portion comprises a web 16 and curled sidewalls 18. Terminal 12 is secured to the end of a wire 24 by crimped connections 20 and 22 as shown.

The tab-type terminal has an upper or free end 26, a lower mounting end 28, oppositely facing parallel major surfaces 30, and oppositely facing parallel side edge surfaces 32.

The tab has a base portion 34 having major surfaces which are co-planar with the major surfaces 30 of the tab and which extend laterally as shown at 36 beyond the edge surfaces 32. These extentions 36 provide shoulders 38 which are directed towards the free end 26 of the tab and which act as stops for the receptacle 14.

A mounting leg 40 extends from the base portion 34 centrally between the side edges of the base portion.

Figure 3:
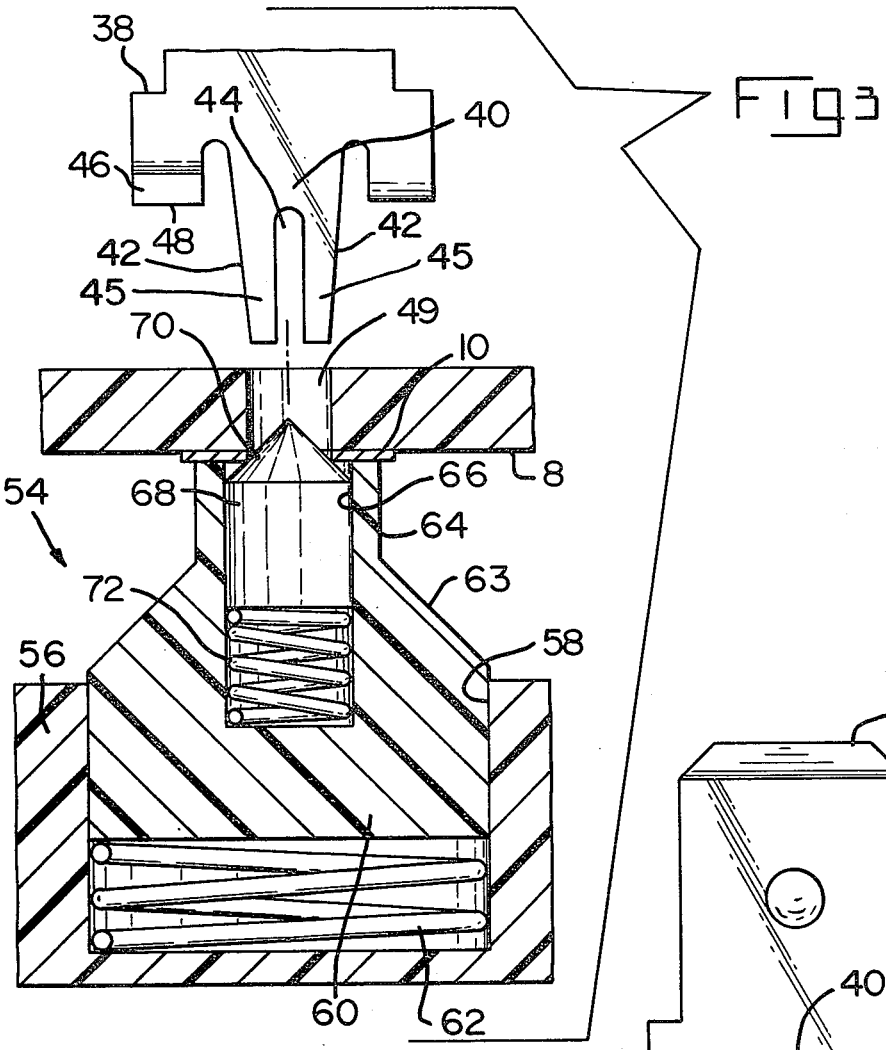
FIG. 3 is a view showing the tooling for securing the terminal tab in accordance with the invention to a circuit board and showing a terminal tab in alignment with a hole in the circuit board.

The mounting leg has convergent side edges 42, FIG. 3, and a slot 44 which extends from the lower end of the mounting leg towards the base portion 34. This slot divides the mounting leg into two sections 45 which are of decreasing width with increasing distance from the base portion.

A pair of stabilizing arms 46 extend in opposite directions and normally of the parallel planes of the surfaces 30 of the base portion 34. These stabilizing arms are produced by simply bending portions of the flat blank of the terminal in opposite directions and have co-planar downwardly facing stabilizing surfaces 48 which bear against the surface 4 of the circuit board.

Figure 2:
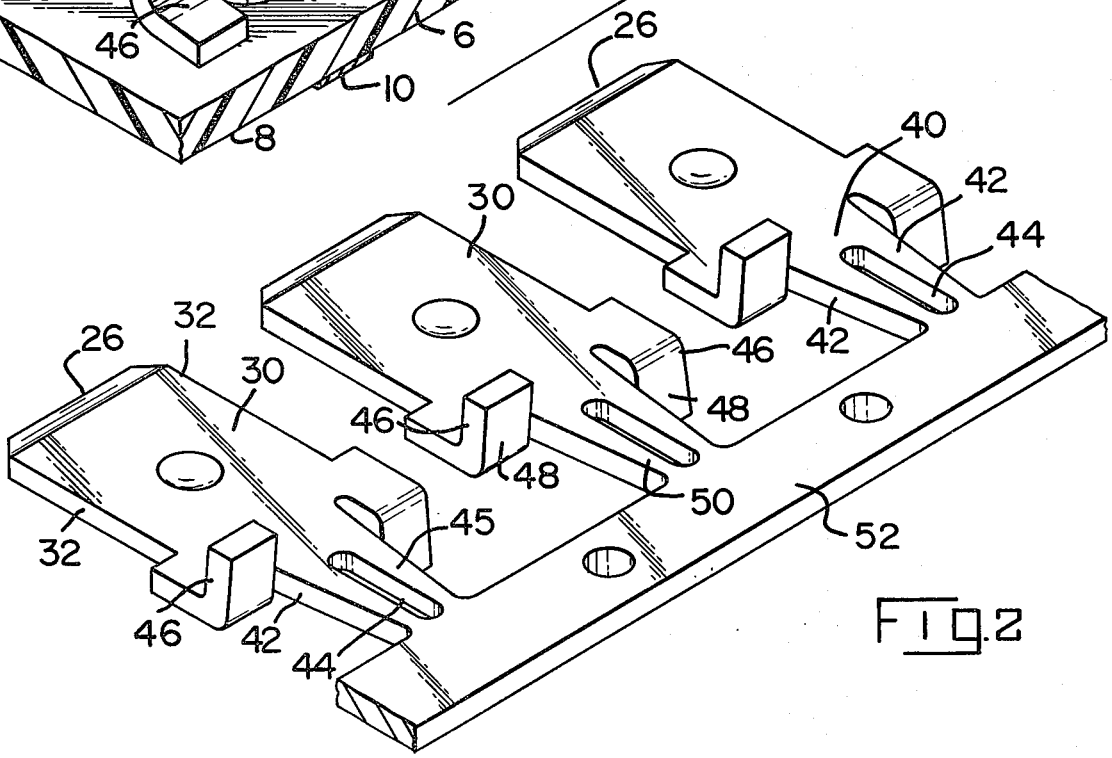
FIG. 2 is a perspective view of a section of a strip of terminal tabs.
Figure 4:
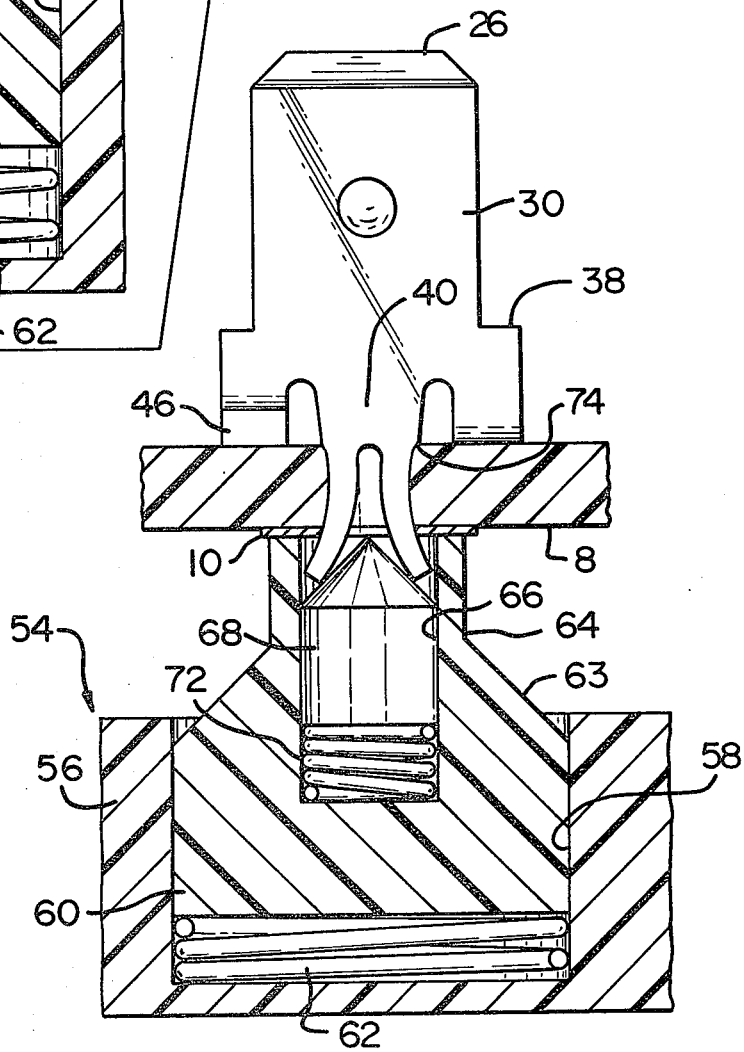
FIG. 4 is a view similar to FIG. 3 showing the positions of the parts at the conclusion of the clinching process in which the terminal is secured to the circuit board.

As shown in FIG. 2, tab-type terminals in accordance with the invention are produced in the form of a continuous strip with the ends 50 of the sections 45 of the leg of each terminal integral with a continuous carrier strip 52. Terminals can be removed from the strip at the time of installation on the circuit board by means of automatic or semi-automatic machines. FIGS. 3 and 4 show the essential features of an apparatus for installing terminals on a circuit board.

The staking or clinching tooling 54 comprises a base block 56 having a recess 58 therein which contains a floating support block 60. The support block 60 rests on a relatively stiff coil spring 62 so that block 60 can be moved downwardly as will be explained below.

Support block 60 has a conical upper portion 63 which merges with a cylindrical portion 64. A cylindric recess 66 extends inwardly through the cylindrical portion 64 and the forming tool 68 is slideably mounted in this recess and supported by a coil spring 72. The spring 72 is less stiff than the spring 62 so that the tooling member 68 will be depressed in recess 66 prior to compression of the spring 62. The upper end of the tooling member has a conical surface 70. The diameter of the hole 49 in the circuit board is less than the diameter of the cylindrical portion of the forming tool 68.

Figure 5:
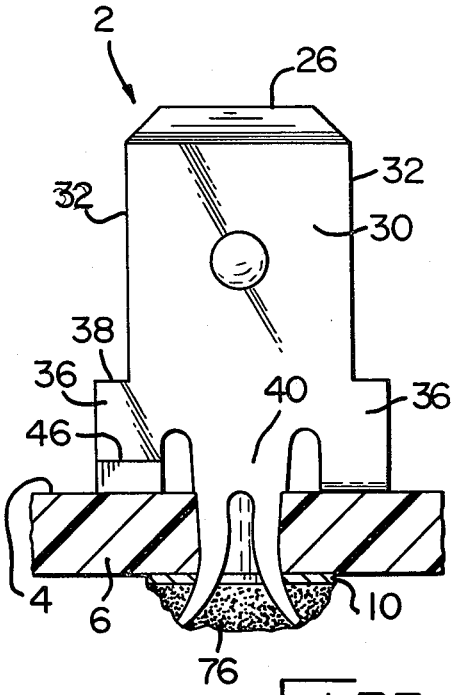
FIG. 5 is a view of a terminal tab soldered to a conductor on the underside of the circuit board.

The procedure for mounting the terminal 2 on the circuit board 6 is as follows:

The circuit board is positioned on the cylindrical portion 64 of the support block 60 with the cylindrical portion 70 of the staking tool 68 extending to the circuit board hole 49. The tab-type terminal is positioned in alignment with the hole as shown in FIG. 3 and moved downwardly by application of forces thereto by a ram-like member. When the lower ends of the sections 45 of the leg 40 move against the staking tool 68, the staking tool is initially moved downwardly with accompanying compression of the spring 72. Upon further downward movement of the terminal the sections 45 of the leg 40 are deformed or bent in opposite directions away from each other and in their original planes. Downward movement of the terminal and deformation continues until the surfaces 48 of the stabilizer arms 46 are against the upper surface 4 of the circuit board. During deformation of the leg sections, they are forced into the circuit board adjacent to the lower surface board 8 thereof. Additionally, it is desireable to dimension the leg such that the upper portion thereof shown at 74, FIG. 4, will also be forced into the circuit board adjacent to the surface 4. The deformation of the two sections of the leg and the movement of the leg into the circuit board hole thus provides a snug inteference fit of the leg in the circuit board hole. This interference fit, coupled with the support provided by the support arms 46 will securely hold the tab on the circuit board in a manner such that it will withstand the stresses imposed when the receptacle 14 is coupled to the tab. Subsequent to insertion, the lower portion of the leg sections are soldered to the circuit board conductor 10 as shown at 76, FIG. 5.

It will be seen from the foregoing description that a terminal tab in accordance with the invention is of a extremely simple and easily produced shape and can be installed on a circuit board by a simple and straight-forward staking or clinching operation. After installation, the terminal will be securely held mechanically of the circuit board so that the solder connection 76 will not be disturbed when a receptacle is coupled with the tab.

What is claimed is:

1. A tab-type terminal of the type comprising a flat rectangular tab having a free end and a mounting end, the mounting end having mounting means for mounting the terminal on a circuit board, the tab having oppositely facing parallel major surfaces and oppositely facing parallel edge surfaces extending from the free end to the mounting end, the terminal being characterized in that:

the mounting end comprises a base portion having oppositely facing major surfaces which are co-planar with the major surfaces of the tab, the base portion extending laterally beyond the edge surfaces of the tab whereby stop shoulders, directed towards the free end of the tab, are provided for a receptacle coupled to the tab, a mounting leg extends from the base portion, the mounting leg being located between the side edges of the base portion, the mounting leg having convergent side edges extending towards the base portion, the slot dividing the mounting leg into two side-by-side co-planar sections, a pair of stabilizing arms extend in opposite directions from the base portion normally of the planes of the major surfaces of the base portion, the stabilizing arms having co-planar support surfaces for stabilizing the terminal on one surface of a circuit board, the stabilizing arms having been formed by bending portions of the flat blank of the terminal in opposite directions until the arms extend at substantially right angles from the flat base portion, the co-planar support surfaces being extensions of the major surfaces of the base portion and not edge surfaces whereby the tab can be mounted on a circuit board by inserting the mounting leg through a hole in the circuit board until the support surfaces are against the one surface of the circuit board and thereafter bending the two sections of the mounting leg into engagement with the circuit board at the other surface thereof.

2. A tab-type terminal as set forth in claim 1 characterized in that the end of the mounting leg is integral with a carrier strip having a plurality of identical tab-type terminals extending therefrom at spaced intervals.

3. A tab-type terminal as set forth in either of claims 1 of 2 characterized in that the mounting leg is located centrally between the stabilizing arms.

4. A tab-type terminal mounted on one surface of a circuit board and extending normally of the plane of the circuit board, the terminal having a flat rectangular tab having a free end and a mounting end, the mounting end having mounting means extending into a hole in the circuit board, the tab having oppositely facing parallel major surfaces and oppositely facing parallel edge surfaces extending from the free end to the mounting end, the terminal being characterized in that:

the mounting end comprises a base portion having oppositely facing major surfaces which are co-planar with the major surfaces of the tab, the base portion extending laterally beyond the edge surfaces of the tab whereby stop shoulders, directed towards the free end of the tab, are provided for a receptacle coupled to the tab, a mounting leg extends from the base portion through the hole in the circuit board, the mounting leg located between the side edges of the base portion and having side edges and a slot therein between the side edges extending towards the base portion, the slot dividing the mounting leg into two sections, a pair of stabilizing arms extend in opposite directions from the base portion normally of the plane of major surfaces of the base portion, the stabilizing arms having co-planar support surfaces which are against the one surface of the circuit board, the stabilizing arms having been formed by bending portions of the flat blank of the terminal in opposite directions until the arms extend at substantially right angles from the flat base portion, the co-planar support surfaces being extensions of the major surfaces of the base portion and not edge surfaces, the two sections of the mounting leg being laterally deformed and serving to clinch the terminal to the circuit board.

5. A tab-type terminal mounted on one surface of a circuit board as set forth in claim 4 characterized in that the two sections of the mounting leg are laterally deformed in opposite directions away from each other and lie in the plane of the base portion of the terminal.

6. A tab-type terminal mounted on a circuit board as set forth in either of claims 4 or 5, the side edges of the mounting leg being convergent, portions of the mounting leg adjacent to the base portion having an interference fit in the hole in the circuit board at the one surface thereof.

7. A tab-type terminal mounted on a circuit board as set forth in claim 6 characterized in that the two sections of the base portion extend arcuately and divergently from the outer surface of the circuit board and have an interference fit in the hole in the circuit board at the other surface.

* * * * *